US008397645B2

(12) United States Patent
Aschauer et al.

(10) Patent No.: US 8,397,645 B2
(45) Date of Patent: Mar. 19, 2013

(54) STORAGE AND RETRIEVAL MACHINE

(75) Inventors: Herbert Aschauer, Wels (AT); Ronald Fessl, Wels (AT)

(73) Assignee: Swisslog Evomatic GmbH, Sipbachzell (AU)

( * ) Notice: Subject to any disclaimer, the term of this patent is extended or adjusted under 35 U.S.C. 154(b) by 0 days.

(21) Appl. No.: 12/555,103

(22) Filed: Sep. 8, 2009

(65) Prior Publication Data

US 2010/0068022 A1 Mar. 18, 2010

(30) Foreign Application Priority Data

Sep. 8, 2008 (AT) ..... A 1393/2008
Oct. 2, 2008 (AT) ..... GM 553/2008

(51) Int. Cl.
*B61B 13/04* (2006.01)

(52) U.S. Cl. ..... 105/141; 414/630; 414/277; 104/118; 104/121; 187/244

(58) Field of Classification Search ..... 104/172.3, 104/173.1, 176, 118, 119, 124, 127, 128, 104/139, 245, 246, 247, 93–95; 105/141, 105/144, 145, 146; 414/630
See application file for complete search history.

(56) References Cited

U.S. PATENT DOCUMENTS 3,424,322 A * 1/1969 Sanford ..... 414/275
3,661,280 A * 5/1972 Atwater ..... 414/282
5,397,211 A * 3/1995 Lloyd et al. ..... 414/663
5,423,652 A * 6/1995 Thiede ..... 414/543
6,467,582 B1 * 10/2002 Nakashima et al. ..... 187/244
7,281,608 B2 * 10/2007 Hansl et al. ..... 187/226
7,575,407 B2 * 8/2009 Tsujimoto ..... 414/279
2002/0017433 A1 * 2/2002 Nakashima et al. ..... 187/249
2004/0216957 A1 * 11/2004 Hansl et al. ..... 187/247
2006/0021540 A1 * 2/2006 Austin ..... 104/118
2006/0060106 A1 * 3/2006 Ueda ..... 105/144
2010/0031845 A1 * 2/2010 Cardoni ..... 104/118
2010/0058950 A1 * 3/2010 Aschauer et al. ..... 105/141
2010/0068022 A1 * 3/2010 Aschauer et al. ..... 414/630
2010/0089274 A1 * 4/2010 Austin ..... 104/118

FOREIGN PATENT DOCUMENTS

DE 19534291 A1 * 3/1997
DE 19631511 A1 4/1997
EP 1061035 A2 12/2000

* cited by examiner

*Primary Examiner* — S. Joseph Morano
*Assistant Examiner* — Jason C Smth
(74) *Attorney, Agent, or Firm* — Ladas & Parry LLP

(57) ABSTRACT

Storage and retrieval machine with a mast (10), at least one chassis (1, 1') for supporting the mast (10), at least one rail (4, 4'), on which the at least one chassis (1, 1') can be moved back and forth, as well as at least one lift carriage (1") vertically shiftable on the mast (10), wherein the mast (10) is formed of at least two supports (11, 11') that are spaced from each other in the moving direction of the at least one chassis (1, 1') and are connected to each other via at least one transversal bar (12, 12') to obtain a mast profile, wherein the attachment of the at least one transversal bar (12, 12') to the supports is resistant to bending.

16 Claims, 5 Drawing Sheets

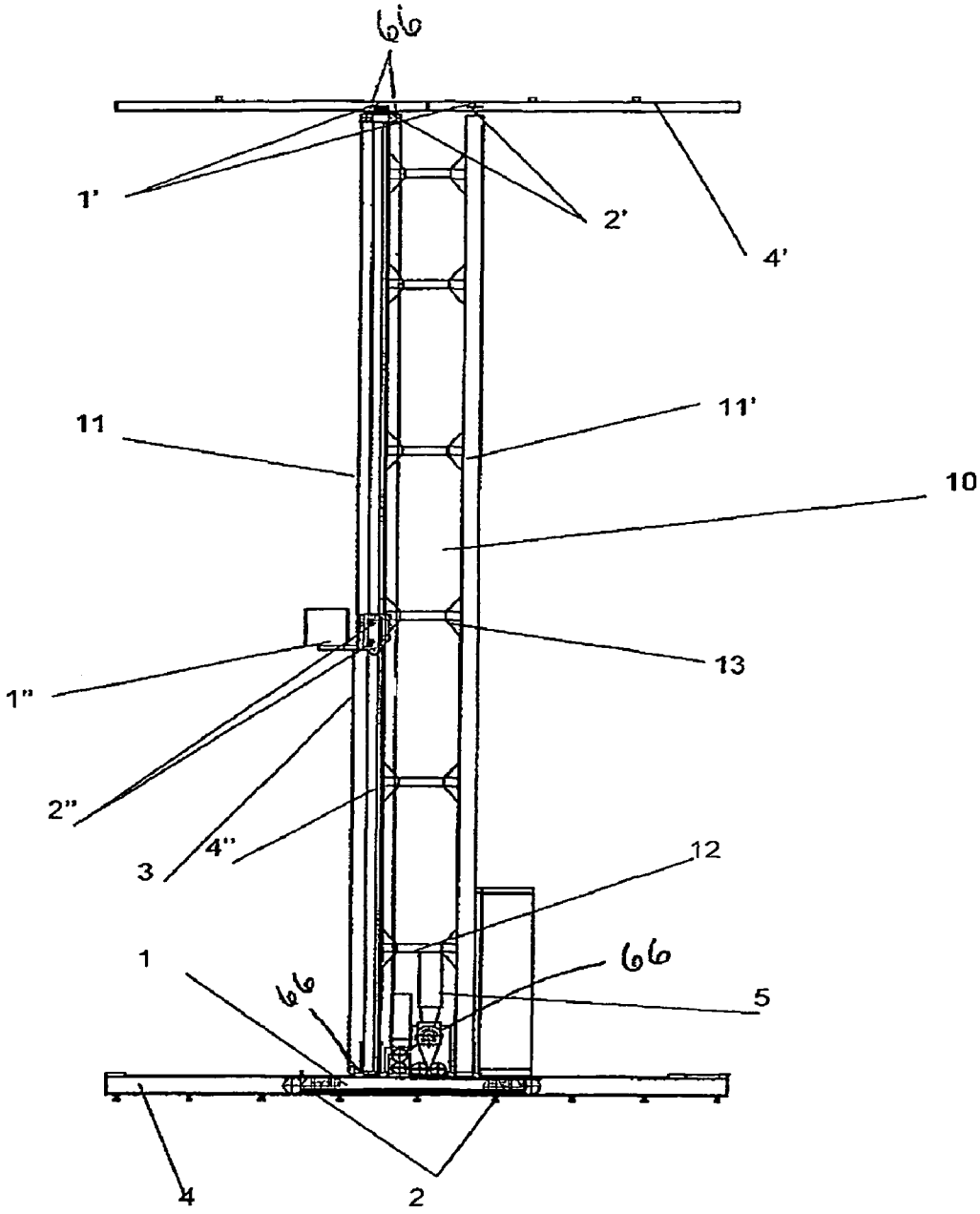
Figur 1

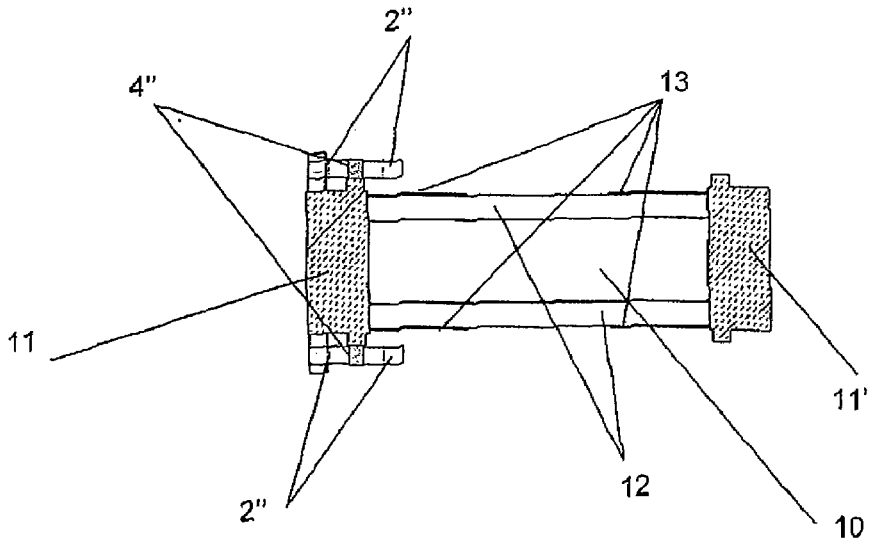
Figur 2A
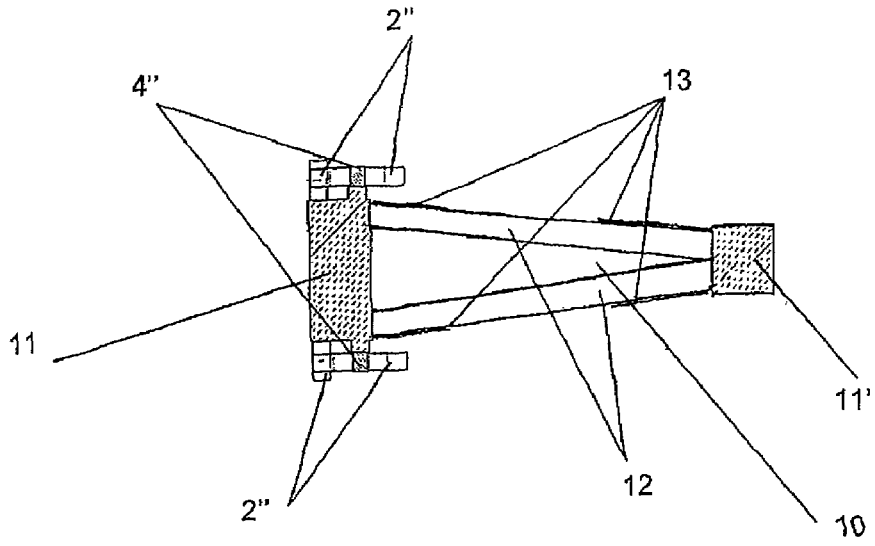
Fig.2B

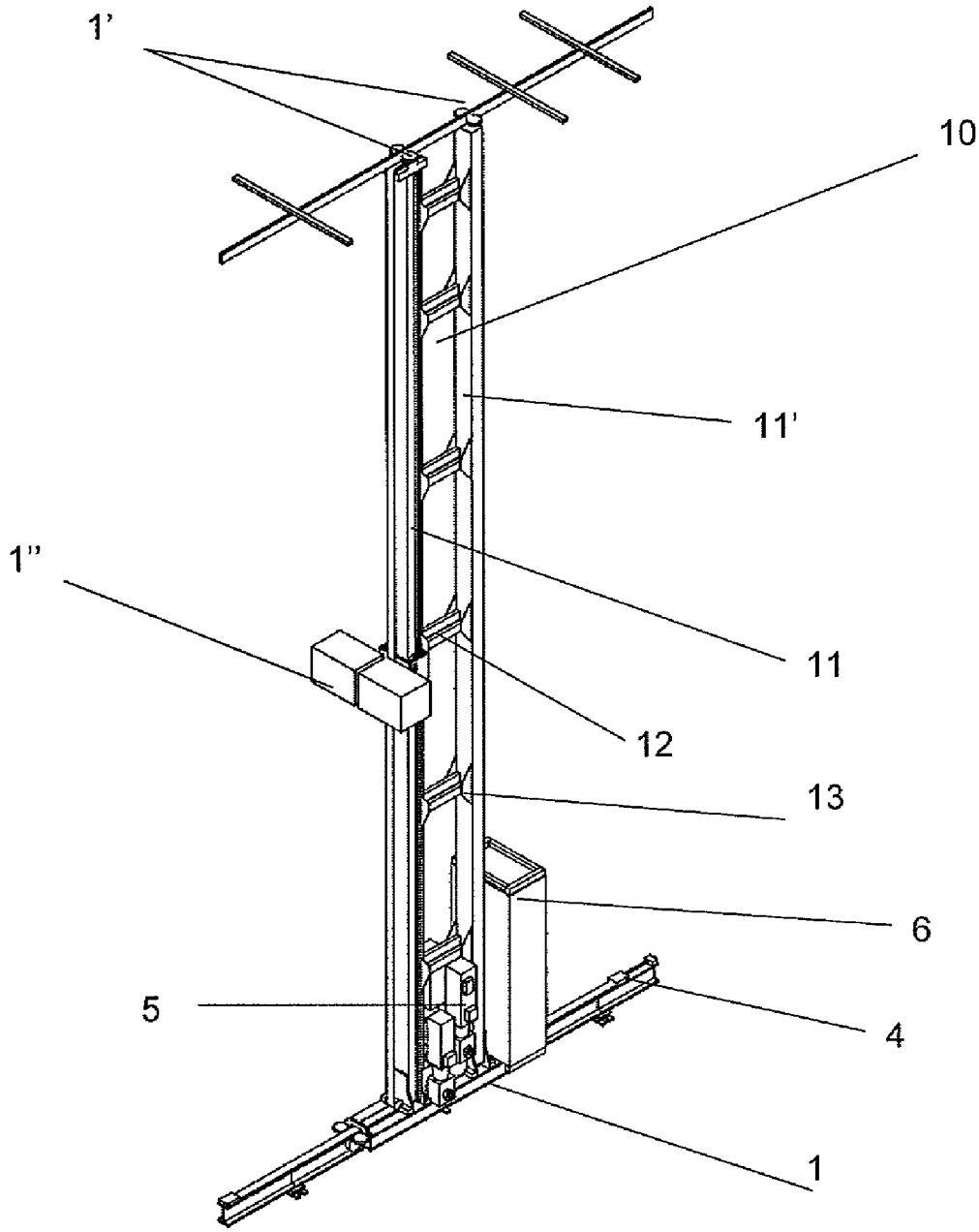
Figur 3

STORAGE AND RETRIEVAL MACHINE

This invention concerns a storage and retrieval machine with a mast, at least one chassis for supporting the mast, at least one rail, on which the at least one chassis can be moved back and forth, as well as at least one lift carriage vertically shiftable on the mast.

The enormous growth of distance selling, especially thanks to the sale of goods via the Internet, has resulted in increased requirements regarding the handling of the flow of material and goods on company premises. High-rack warehouses and automated small-parts warehouses accessible by means of storage and retrieval machines constitute the basis for this development.

Storage and retrieval machines are for example described in the documents DE 196 31 511 A1 and EP 1 061 035 A2.

DE 196 31 511 A1 describes a mast of a storage and retrieval machine with lightweight design, which has an upward tapering. Furthermore, the mast described is provided in a way that the mast interior may be used for installations. This embodiment with rods in the corners of a rectangle thus provides high flexural strength, is, however, disadvantageous with regard to the limited space.

EP 1 061 035 A2 describes a mast of a storage and retrieval machine, which consists of a solid profile and an attached truss structure.

Usually, the lift drive element, which may e.g. be provided in the form of a toothed belt, is positioned on one side of the mast, which is object to a permanent bending stress due to the resulting prestress, which leads to a disadvantage with regard to the machine's statics and positioning accuracy.

Another disadvantage of the mast of known storage and retrieval machines is based on their own high weight, which increases energy costs and in many cases also involves a limitation regarding the mast height.

Consequently, it is the object of this invention to provide a storage and retrieval machine with a mast that is as light as possible but nevertheless stable, in order to keep the dynamic stresses on the elements of the storage and retrieval machine, which are mainly caused by accelerating and decelerating the storage and retrieval machine, as low as possible. The aim is to guarantee an efficient transfer of the vertical and horizontal forces resulting in the mast into the chassis.

Another object of the invention is the provision of a storage and retrieval machine that minimizes mast bending during stress due to lifting movements.

Furthermore, the mast height shall not be limited to given dimensions of components, but a modular design shall allow the provision of different mast heights depending on the respective needs, wherein construction heights of more than 20 meters shall have no disadvantageous effects on the operation of the storage and retrieval machine.

Finally, it is an object of the invention to allow an arrangement of drive systems so that asymmetrical stresses on the chassis and the mast are avoided.

According to the invention, this is solved by forming the mast of at least two supports that are spaced from each other in the moving direction of the at least one chassis and are connected to each other via at least one transversal bar to obtain a mast profile, wherein the attachment of the at least one transversal bar to the supports is resistant to bending.

Forming the mast of two or more supports, which are optimized with regard to the stresses occurring, results in a weight reduction advantageous for the operation of the storage and retrieval machine. The supports are assembled via one or more transversal bars to achieve a mast profile that absorbs dynamic stresses in the longitudinal as well as transverse directions by means of the preferably two supports, which happens exclusively due to the rigid attachment of the transversal beams in the traveling direction, wherein the second support also partially absorbs lateral forces acting on a support. Due to the substantial stress reduction transversal to the traveling direction, the width of the mast may be decreased. Thus, it is possible to choose a profile form for the supports in the mast that substantially corresponds to the width of the mast.

The connection of the mast supports by means of one or more transversal bars results in a very light design and furthermore in the possibility to centrically arrange chassis and drive components in the space between the mast supports.

Another advantage is the easily implementable modular assemblage of the supports to obtain very high masts.

A preferred embodiment of the storage and retrieval machine may thus be that the at least one transversal beam is attached to the supports of the mast via nodes arranged on its ends so that a static and/or dynamic force, which acts on one of the at least two supports, is at least partially absorbed by another support.

The transfer of occurring stresses from a profile or a mast support to another support results in an approximately equal distribution of the loads between the supports and thus relieves the support along which the lift carriage is guided. The supports can thus be formed as clearly less loaded elements, i.e. of a lighter material with less stability such as aluminum and/or with a smaller cross section. The attachment of the transversal beam takes place via a specially formed gusset plate, which is adapted with regard to the desired force transfer, but also with regard to the static and dynamic characteristics of the mast.

The mast preferably consists of individual modules that are connected by screwings. This also allows a simpler and above all more economic adaptation of the mast to different construction heights required. Above all, this is achieved by the fact that due to the smaller profile dimensions, the tool costs for profile manufacture are lower and smaller purchase quantities than with rolled steel profiles are possible. The joint between the individual profiles is provided in the form of screwings and preferably provided for in the respective area of the gusset plate for the transversal bar.

The mast is preferably attached to the carriage of the chassis by means of a screwed connection, which is provided on a specially formed mast foot on the respective mast support.

According to the invention, other connection forms known to a person skilled in the art for attaching the mast to the carriage or connecting the individual modules of the mast are not excluded.

A possible embodiment of the storage and retrieval machine could be that the lift carriage is guided along at least one of the profiles forming the supports of the mast.

A possible embodiment of the storage and retrieval machine could consist in that the at least one chassis comprises a travel drive system, which is arranged within the mast profile between the two supports arranged outside. Consequently, centrically guiding the travel drive belt with respect to the rail in the longitudinal direction and thus a centric traction close to the rail are possible. At the same time, there is an advantageous weight load in the center between the mast supports.

In this connection, it may also be provided that the at least one chassis comprises a lift drive system, which is arranged within the mast profile between the two outside supports, and optionally that the travel drive system and/or the lift drive system are centrically arranged in the movement direction of the chassis. This arrangement has an advantageous effect on the centric course of the lift drive element thus implementable.

The drive motor of the lift chassis, which is guided vertically along the mast, is advantageously arranged at the lower, horizontal chassis of the mast within the supports of the mast, since the horizontal chassis of the mast can then have a shorter length. The latter increases the storage and retrieval machine's working area.

A further embodiment of the inventive storage and retrieval machine may consist in that the lift carriage movable by means of a lift drive element is guided along one of the two supports and that the lift drive element is guided enclosing the one support.

This guidance, enclosing at least one support on both sides, of the drive element of the lift chassis, which is guided vertically on the mast, has the advantage that the tensions in the mast and mast foot are positively effected. The centric traction thus achieved results in a symmetric deformation, which strongly reduced the mast's torsional stress. Consequently, the at lest one support of the mast receives mainly pressure load and hardly any bending stress. This prestress caused by the drive element on the mast is especially advantageous during dynamic traveling.

Thus, the profile forming the support may have weaker dimensions, i.e. be formed of a lighter material with, however, lower strength and/or with a smaller cross section.

According to a further development of the invention, diverters for the lift drive element may be provided at the foot point and the head point of the one support, wherein the lift drive element at the foot point passes through a through hole of the support and wherein the lift drive element is guided on both sides of the one support of the mast.

In addition to the reduction of asymmetrical stresses and the avoidance of undesired superposition of tensions, this results in a strongly improved space situation in the lift carriage guidance area.

Furthermore, in may be provided in this connection that the lift drive element enclosing the one support of the mast is prestressed so that the mast is symmetrically charged with a compressive strain.

A prestress of a mast support of the inventive storage and retrieval machine may be provided in that at least one of the profiles forming the supports of the mast is prestressed by means of the guidance of the drive belt.

This prestress has the effect that the support along which the lift carriage is guided does not experience any bending stress, since the tensile stresses from the prestress are superposed with the prestress of the support. Due to this prestress, the support can receive higher loads or have weaker dimensions by reducing the cross section or by choosing a light material with, however, lower strength.

The lift drive element may, for example, be formed by a drive belt.

It is not excluded according to the invention that the lift chassis of the storage and retrieval machine is driven by other means known to a person skilled in the art or by a combination of such means.

A permanent connection of the mast supports with the chassis may consist in that the supports are screwed onto the chassis at their foot points.

In order to allow a modular design and a construction height as large as possible, it may be provided that the mast supports are each composed of several support elements that are riveted together at their ends, wherein the supports are preferably formed by profiles, especially light metal profiles.

A preferred embodiment of the storage and retrieval machine may be that the rail of the lift chassis guided on the mast is attached to at least one of the profiles forming the supports of the mast.

The rails of the chassis guided on the mast are attached to the supports in a manner so that an eccentric stress on the supports is mostly avoided. The arrangement of the supports is related to an optimization of the cross sectional shape of the profiles forming the supports. The means for attaching the vertical rail are to be chosen so that the rail may at any time be easily adjusted.

According to the invention it is also possible that the profile forming the mast support serves as rail as well.

This optimized inventive conception of the mast structure allows construction heights of up to 24 meters and more, and quick accelerations or decelerations during travel operation of the storage and retrieval machine can be absorbed without disadvantageous effects on the positioning accuracy.

Furthermore, the preferred use of screwed connections instead of welded connections increases product life because fatigue strength problems, as they are common with welded connections, are almost eliminated. Additional advantages arise during assemblage, since individual assembly groups are pre-assembled, can be easily transported and assembled, and, if required, adjusted on site.

In the following, the invention is described in detail by referring to the exemplary embodiments shown in the drawings. Herein, FIG. 1 is a schematic lateral view of an embodiment of the inventive storage and retrieval machine;

FIG. 2A is a horizontal cut through the embodiment according to FIG. 1;

FIG. 2B is a horizontal cut through a further embodiment of the inventive storage and retrieval machine;

FIG. 3 is a graphical (three-dimensional) representation of the embodiment of the inventive storage and retrieval machine shown in FIG. 1;

Figure 4:
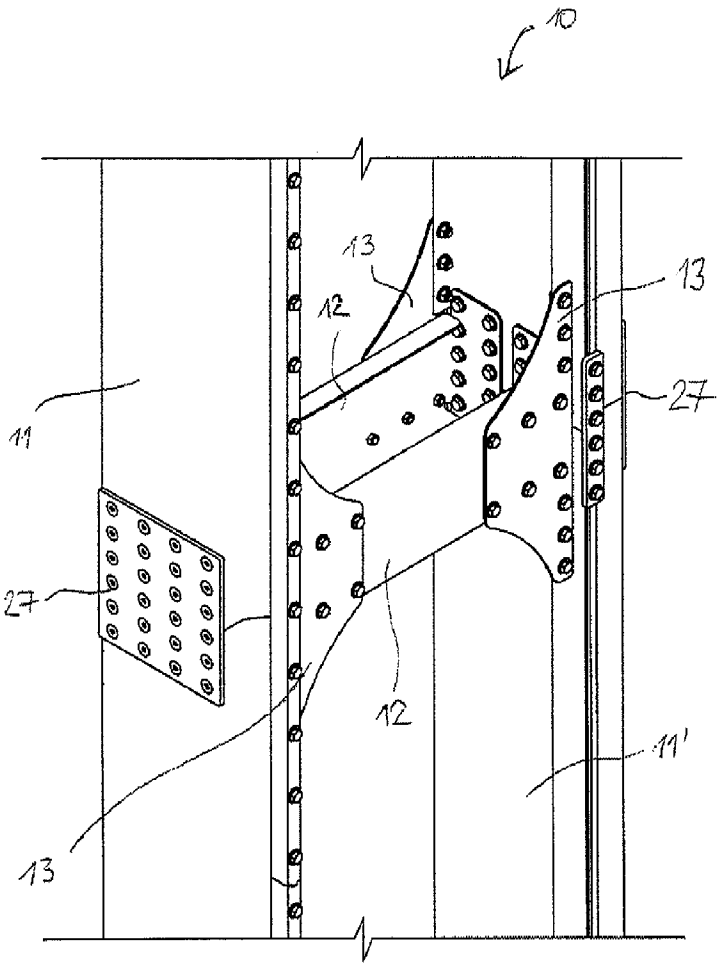
FIG. 4 is a three-dimensional view of a detail of a further embodiment of the inventive storage and retrieval machine.

FIG. 1 and FIG. 3 show a storage and retrieval machine with a mast 10 and two chassis 1, 1' equipped with two guide elements 2, 2' for supporting the mast 10. The chassis 1, 1' can be moved back and forth together with the mast on horizontal rails 4, 4'. Furthermore, a lift carriage 1" including lift guide elements 2" is provided, which is vertically shiftable on a lift rail 4" by means of a lift drive element 3.

According to the invention, the mast 10 is formed of two supports 11, 11', which are spaced apart from each other in the moving direction of the chassis 1, 1' and connected to each other via several transversal bars 12 to obtain a mast profile, wherein the attachment of the transversal bars 12 to the supports 11, 11' is resistant to bending. The supports 11, 11' are for example formed of profiles and screwed onto the chassis 1 at their foot points. Also, more than two supports can be provided in this way to form the mast profile.

The transversal bars 12 are rigidly attached to the supports 11, 11' of the mast 10 via especially formed nodes 13, so that at least part of a horizontal force, which mainly results form an acceleration or deceleration procedure of the storage and retrieval machine, or a vertical force, generally the storage and retrieval machine's own load or the load of the goods to be transported, is transferred from the one support 11 to the second support 11'.

The mast 10 is attached to the two chassis 1, 1', wherein a chassis 1 is arranged at the head point of the mast 10, and a chassis 1' is arranged at the foot point of the mast 10. Due to the light and compact design of the inventive storage and retrieval machine, preferably only the lower chassis 1 is horizontally driven by a drive element not further described.

The lift carriage 1" is guided along the support 11 of the mast 10, wherein a rail 4" intended therefore is attached to the support 11.

The lift drive element 3 guided on both sides of the support 11, e.g. a lift toothed belt, moves the lift carriage 1" and pre-stresses the support 11. The danger of a buckling of the support 11 due to a bending stress, which is caused by the eccentric arrangement of the lift carriage, is minimized.

The lift drive element 3 encloses the support 11 and is on both sides arranged at a distance from the central axis of inertia of the support 11 so that the torque that is caused by the traction forces mainly acting in the lift drive element 3 are almost eliminated.

At the foot point and the head point of the one support 11, diverters 66 for the lift drive element are provided, wherein the lift drive element 3 at the foot point passes through a through hole of the support 11.

On the chassis 1, a travel drive system is provided that comprises a drive motor 5 and is arranged within the mast profile between the two supports 11, 11' positioned outside.

Furthermore, the chassis 1 comprises a lift drive system, which is also arranged within the mast profile between the two supports 11, 11' positioned outside.

The drive motor 5 for driving the horizontal drive element is arranged on the carriage of the chassis 1 in the interior of the mast 10.

FIG. 2A shows the structure of the mast 10. The supports 11, 11' of the mast 10 provided in the form of profiles are arranged at a distance from each other by the transversal bars 12, each two of which are arranged parallel at the same height. The nodes 13 for rigidly connecting the transversal bars 12 and the respective supports 11, 11' are formed by gusset plates.

Attached to the support 11 is the rail 4", along which the lift carriage 1" is guided via guide elements 2".

The profiles of the supports 11, 11' are preferably extruded aluminum hollow profiles, may, however, also be corresponding solid profiles as shown in FIG. 2.

In the embodiment of FIG. 2B, for reaching a low mast height, the profile of the support 11' is, for the purpose of reducing weight and material, formed with a smaller cross section than the support 11, which guides the lift carriage 1", so that the transversal bars 12 are arranged at an angle to each other deviating from the parallel position. In this exemplary embodiment, the transversal bars 12 are also rigidly attached to the supports 11, 11'.

FIG. 4 shows a connection in case of a mast 10 consisting of several pieces, in which the mast supports 11, 11' are assembled of several elements and attached to each other via parallel transversal bars or cross beams 12. The mast supports 11, 11' provided in the form of aluminum profiles are divided centrically in the area of the transversal bars 12 and the gusset plates 13 and attached to each other via different additional plates 27.

Figure 5:
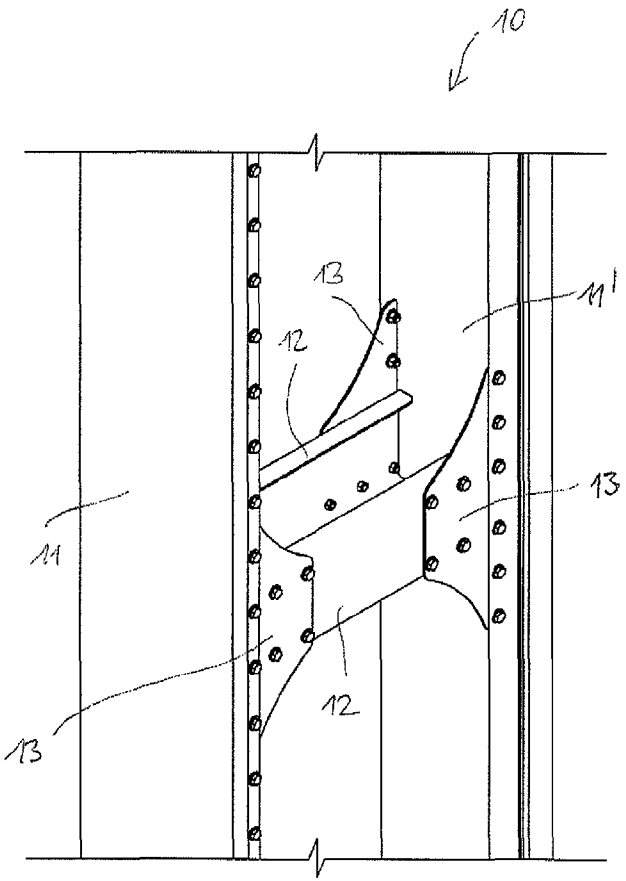
FIG. 5 is a three-dimensional view of a detail of a further embodiment of the inventive storage and retrieval machine.

In comparison, FIG. 5 shows an embodiment in which the mast supports 11, 11' are rigidly connected to the transversal bars 12 via the gusset plates 13, wherein the mast supports are not divided in this area.

The invention claimed is:

1. Storage and retrieval machine comprising a mast, at least one chassis for supporting the mast, at least one horizontal rail, on which the at least one chassis can be moved back and forth, as well as at least one lift carriage vertically shiftable on the mast, the mast being formed of at least two supports that are spaced from each other in the moving direction of the at least one chassis, wherein each of the at least two supports is arranged centrally with respect to the at least one horizontal rail and the two supports are connected to each other via at least one transversal bar which extends perpendicular to the length of the at least two supports to obtain a mast profile, wherein the attachment of the at least one perpendicular transversal bar to the at least two supports is resistant to bending and rigid via nodes, so that at least part of the horizontal force, which mainly results from an acceleration or deceleration procedure of the storage and retrieval machine, or a vertical force, generally the storage and retrieval machine's own load or the load of the goods to be transported, is transferred from the one support to the second support of the at least two supports.

2. Storage and retrieval machine according to claim 1, wherein the at least one transversal bar is attached to the supports of the mast via the nodes arranged on its ends so that a static and/or dynamic force, which acts on one of the at least two supports, is at least partially absorbed by another one of the supports.

3. Storage and retrieval machine according to claim 1, wherein the at least one chassis comprises a travel drive system, which is arranged within the mast profile between the two supports arranged outside.

4. Storage and retrieval machine according to claim 3 wherein the travel drive system is centrically arranged in the movement direction of the chassis.

5. Storage and retrieval machine according to claim 1, wherein the at least one chassis comprises a lift drive system, which is arranged within the mast profile between the two outside supports.

6. Storage and retrieval machine according to claim 5 wherein the lift drive system is centrically arranged in the movement direction of the chassis.

7. Storage and retrieval machine according to claim 1, wherein the lift carriage movable by means of a lift drive element is guided along one of the two supports and that the lift drive element is guided enclosing the one support.

8. Storage and retrieval machine according to claim 7, wherein diverters for the lift drive element are provided at the foot point and the head point of the one support as guiding means.

9. Storage and retrieval machine according to claim 7, wherein the lift drive element is guided on both sides of the one support of the mast.

10. Storage and retrieval machine according to claim 7, wherein the lift drive element enclosing the one support of the mast is prestressed so that the mast is symmetrically charged with a compressive strain.

11. Storage and retrieval machine according to claim 7, wherein the lift drive element is formed by a drive belt.

12. Storage and retrieval machine according to claim 1, wherein the supports are screwed onto the chassis at their foot points.

13. Storage and retrieval machine according to claim 1, wherein the mast supports are attached to each other by additional plates that are riveted together at their ends.

14. Storage and retrieval machine according to claim 1, wherein the rigid attachment of the at least one transversal beam to the supports is formed by gusset plates.

15. Storage and retrieval machine according to claim 1, wherein the supports are formed by profiles.

16. Storage and retrieval machine according to claim 1, wherein the supports are formed by light metal profiles.

* * * * *